US008746456B1

(12) United States Patent
Bradley

(10) Patent No.: US 8,746,456 B1
(45) Date of Patent: Jun. 10, 2014

(54) FOOD AND/OR BEVERAGE TRAY AND A METHOD OF USING THE SAME

(71) Applicant: Donald Joseph Bradley, Westerville, OH (US)

(72) Inventor: Donald Joseph Bradley, Westerville, OH (US)

( * ) Notice: Subject to any disclaimer, the term of this patent is extended or adjusted under 35 U.S.C. 154(b) by 0 days.

(21) Appl. No.: 14/020,832

(22) Filed: Sep. 7, 2013

Related U.S. Application Data

(60) Provisional application No. 61/699,781, filed on Sep. 11, 2012.

(51) Int. Cl.
*B65D 1/36* (2006.01)

(52) U.S. Cl.
USPC ..... 206/562; 206/815; 220/556; 229/904

(58) Field of Classification Search
USPC ..... 206/562, 1.7, 1.8, 818, 815, 564, 557, 206/216, 217, 223, 541; 229/904; 220/556, 220/575
See application file for complete search history.

(56) References Cited

U.S. PATENT DOCUMENTS

| | | | | | |
|---|---|---|---|---|---|
| 2,512,963 | A | * | 6/1950 | Peiker | 206/563 |
| 2,766,919 | A | * | 10/1956 | Randall | 294/144 |
| 3,856,136 | A | * | 12/1974 | Governale | 206/1.7 |
| 3,955,672 | A | | 5/1976 | Brundage | |
| 4,219,144 | A | | 8/1980 | Hagelberg | |
| 5,152,398 | A | | 10/1992 | Forestal et al. | |
| 5,323,910 | A | | 6/1994 | van de Graaf, Jr. | |
| 5,346,070 | A | | 9/1994 | McSpadden | |
| 5,390,798 | A | * | 2/1995 | Yanuzzi | 206/562 |
| 5,634,568 | A | * | 6/1997 | Wawrzyniak | 220/510 |
| 5,678,694 | A | | 10/1997 | Tanaka et al. | |
| 5,697,512 | A | | 12/1997 | Brickley | |
| 5,850,910 | A | * | 12/1998 | Broyles et al. | 206/1.8 |
| 5,947,011 | A | * | 9/1999 | Xu | 99/357 |
| 6,129,235 | A | * | 10/2000 | Creske | 220/575 |
| 6,264,026 | B1 | | 7/2001 | Bradley | |
| 6,622,885 | B1 | | 9/2003 | Erman | |
| 6,651,836 | B1 | * | 11/2003 | Hofheins et al. | 220/575 |
| 7,000,799 | B1 | | 2/2006 | Hamre | |
| 7,798,354 | B2 | * | 9/2010 | Stowers, Sr. | 220/23.8 |
| 8,292,118 | B2 | * | 10/2012 | Ebesu | 220/575 |
| 8,573,437 | B1 | * | 11/2013 | Evans | 220/737 |
| 2006/0118453 | A1 | * | 6/2006 | Hillebrecht et al. | 206/562 |
| 2006/0243633 | A1 | | 11/2006 | Fialova et al. | |
| 2006/0283719 | A1 | * | 12/2006 | Surabischwili | 206/1.7 |
| 2007/0215512 | A1 | | 9/2007 | Bellissimo | |
| 2009/0120832 | A1 | | 5/2009 | Munden | |
| 2010/0230419 | A1 | | 9/2010 | Joseph | |
| 2011/0259763 | A1 | * | 10/2011 | O'Brien | 206/1.7 |

* cited by examiner

*Primary Examiner* — Jacob K Ackun
(74) *Attorney, Agent, or Firm* — The Law Office of Patrick F. O'Reilly III, LLC

(57) ABSTRACT

A food and/or beverage tray includes a tray body portion having an upper surface and a lower surface, a first portion of the lower surface of the tray body portion configured to rest on the forearm of the user, a second portion of the lower surface of the tray body portion configured to rest on the hand of the user; a notch provided in a first end of the tray body portion, the notch configured to receive a cross-sectional portion of an arm of the user near the elbow; and at least one finger aperture disposed through the tray body portion, the at least one finger aperture configured to accommodate a finger of the hand of the user, the at least one finger aperture being located proximate to a second end of the tray body portion that is disposed generally opposite to the first end of the tray body portion.

16 Claims, 14 Drawing Sheets

Section C-C

Section D-D

FOOD AND/OR BEVERAGE TRAY AND A METHOD OF USING THE SAME

CROSS-REFERENCE TO RELATED APPLICATIONS

This patent application claims priority to, and incorporates by reference in its entirety, U.S. Provisional Patent Application No. 61/699,781, entitled "Food And/Or Beverage Tray And A Method Of Using The Same", filed on Sep. 11, 2012.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a food and/or beverage tray that is configured to be held by a user. More particularly, the invention relates to a food and/or beverage tray that is configured to be supported using a forearm and a hand of a user while it is being held by the user.

2. Background

There are many enjoyable social functions that require the attendees of the event to eat and drink while standing. One common example of such a social function is tailgating before a sporting event. During tailgating, individuals typically eat and drink while in a standing position. Trying to eat and drink in a standing position presents various difficulties that can detract from the enjoyment of the event. For example, it is typically difficult for an individual to balance both food and a beverage when standing. For proper stability, conventional plates must be grasped by both hands of a user. Also conventional plates are not generally designed to accommodate a beverage. Thus, a user of a conventional plate is often forced to perform a balancing act, wherein he or she attempts to balance a beverage on the flat surface of the plate. Frequently, because it is difficult to keep the plate in an entirely level position, this balancing act leads to the spillage of the beverage, the dropping of the plate, or both. Thus, in such a case, an attendee of a social gathering is unable to realize the full enjoyment of the event.

Therefore, what is needed is a food and/or beverage tray that facilitates eating and drinking by a user while in a standing position. Moreover, a food and/or beverage tray is needed that is capable of being supported by both a forearm and a hand of a user so as to increase its overall stability. Furthermore, there is a need for a food and/or beverage tray that is capable of being stably supported by a single hand of a user so that the user's other hand is free to grasp the food and/or beverage disposed on the tray.

BRIEF SUMMARY OF EMBODIMENTS OF THE INVENTION

Accordingly, the present invention is directed to a food and/or beverage tray and a method of using the same that substantially obviates one or more problems in the art hereinbefore discussed.

In accordance with one or more embodiments of the present invention, there is provided a food and/or beverage tray configured to be supported using a forearm and a hand of a user, which includes: a tray body portion having an upper surface and a lower surface, a first portion of the lower surface of the tray body portion configured to rest on the forearm of the user, a second portion of the lower surface of the tray body portion configured to rest on the hand of the user; a notch provided in a first end of the tray body portion, the notch being configured to receive a cross-sectional portion of an arm of the user, the cross-sectional portion of the arm of the user being located proximate to an elbow of the user; and at least one finger aperture disposed through the tray body portion, the at least one finger aperture configured to accommodate a finger of the hand of the user, the at least one finger aperture being located proximate to a second end of the tray body portion that is disposed generally opposite to the first end of the tray body portion.

In a further embodiment of the present invention, the tray body portion comprises an upturned edge at its periphery, the upturned edge of the tray body portion configured to prevent food items from falling off the tray if the tray is tilted by the user.

In yet a further embodiment, the upturned edge of the tray body portion extends around the entirety of the periphery of the tray body portion.

In still a further embodiment, the upturned edge of the tray body portion extends around a substantial portion of the periphery of the tray body portion.

In yet a further embodiment, a cross-section of the upturned edge comprises one or more filleted portions.

In still a further embodiment, the food and/or beverage tray further comprises at least one beverage container holder formed in the tray body portion.

In yet a further embodiment, the at least one beverage container holder comprises a plurality of beverage container holders.

In still a further embodiment, the at least one beverage container holder comprises at least one beverage aperture disposed through the tray body portion, the at least one beverage aperture bounded by a plurality of bendable flap members connected to the tray body portion.

In yet a further embodiment, the plurality of bendable flap members are configured to be bent in a generally downward direction such that the bendable flap members project from the lower surface of the tray body portion in a folded state.

In still a further embodiment, each of the plurality of bendable flap members comprises at least one line of weakness at the location where each bendable flap member connects to the tray body portion.

In yet a further embodiment, the at least one line of weakness comprises a groove on either the upper surface or the lower surface of the tray body portion.

In still a further embodiment, the at least one line of weakness comprises two generally aligned grooves on both the upper surface and the lower surface of the tray body portion, the two generally aligned grooves being disposed in a substantially mirrored relationship with respect to a central reference plane passing through the tray body portion.

In yet a further embodiment, the at least one line of weakness comprises a series of spaced apart slits.

In still a further embodiment, the at least one beverage container holder comprises at least one frusto-conical beverage well that is integrally formed with the tray body portion, the at least one frusto-conical beverage well including a tapered, frusto-conical side wall and a generally planar bottom wall.

In yet a further embodiment, the at least one finger aperture comprises a plurality of finger apertures disposed in a spaced apart relationship through the tray body portion, the plurality of finger apertures configured to accommodate the fingers of different users with varying forearm lengths, the plurality of finger apertures being located proximate to the second end of the tray body portion.

In still a further embodiment, the tray body portion further comprises an elongated slot disposed therethrough for holding a portable electronic device.

In yet a further embodiment, the elongated slot is longitudinally bounded by two convex sides for retaining the portable electronic device in a friction fit engagement.

In still a further embodiment, a portion of the upper surface of the tray body portion comprises indicia printed or affixed thereon.

In yet a further embodiment, the indicia comprises one of the following: (i) a company name and/or logo; (ii) a sports team name and/or logo; and (iii) a celebratory message or theme.

In still a further embodiment, the tray body portion has a generally planar shape.

In accordance with one or more other embodiments of the present invention, there is provided a food and/or beverage tray configured to be supported using a forearm and a hand of a user, which includes: a tray body portion having an upper surface and a lower surface, a portion of the lower surface of the tray body portion configured to rest on the forearm of the user; a notch provided in a first end of the tray body portion, the notch being configured to receive a cross-sectional portion of an arm of the user, the cross-sectional portion of the arm of the user being located proximate to an elbow of the user; and a plurality of finger apertures disposed in a spaced apart relationship through the tray body portion, the plurality of finger apertures configured to accommodate the fingers of different users with varying forearm lengths, the plurality of finger apertures being located proximate to a second end of the tray body portion that is disposed generally opposite to the first end of the tray body portion.

In accordance with yet one or more other embodiments of the present invention, there is provided a food and/or beverage tray configured to be supported using a forearm and a hand of a user, which includes: a tray body portion having an upper surface and a lower surface, a portion of the lower surface of the tray body portion configured to rest on the forearm of the user; at least one beverage container holder formed in the tray body portion; and a plurality of finger apertures disposed in a spaced apart relationship through the tray body portion, the plurality of finger apertures configured to accommodate the fingers of different users with varying forearm lengths, the plurality of finger apertures being located proximate to a second end of the tray body portion that is disposed generally opposite to a first end of the tray body portion.

In accordance with still one or more other embodiments of the present invention, there is provided a method of using a food and/or beverage tray, the method comprising the steps of: (i) providing a food and/or beverage tray configured to be supported using a forearm and a hand of a user, which includes: a tray body portion having an upper surface and a lower surface, a portion of the lower surface of the tray body portion configured to rest on the forearm of the user; a notch provided in a first end of the tray body portion, the notch being configured to receive a cross-sectional portion of an arm of the user, the cross-sectional portion of the arm of the user being located proximate to an elbow of the user; and a plurality of finger apertures disposed in a spaced apart relationship through the tray body portion, the plurality of finger apertures configured to accommodate the fingers of different users with varying forearm lengths, the plurality of finger apertures being located proximate to a second end of the tray body portion that is disposed generally opposite to the first end of the tray body portion; (ii) positioning a cross-sectional portion of an arm of the user in the notch provided in the first end of the tray body portion; (iii) selecting one of the plurality of finger apertures based upon the length of the user's forearm; (iv) positioning one of: (a) an index finger; (b) a middle finger; and (c) a ring finger of the user in the selected one of the plurality of finger apertures; and (v) supporting the food and/or beverage tray using both the forearm and the hand of the user.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

1. First Embodiment

Figure 1:
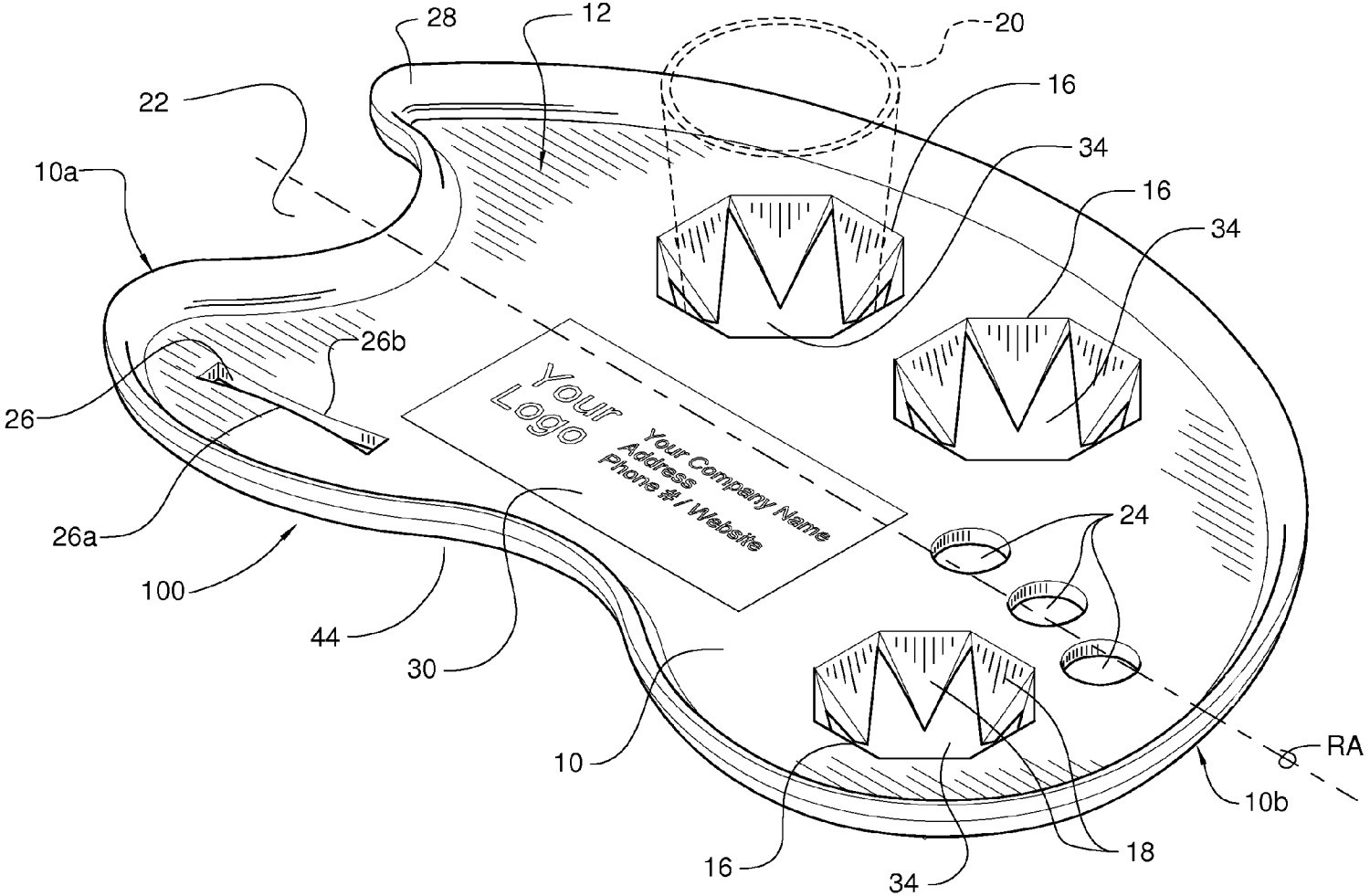
FIG. 1 is a top perspective view of the food and/or beverage tray according to a first embodiment of the invention, wherein the bendable flaps of the beverage container holders are in a folded state.
Figure 2:
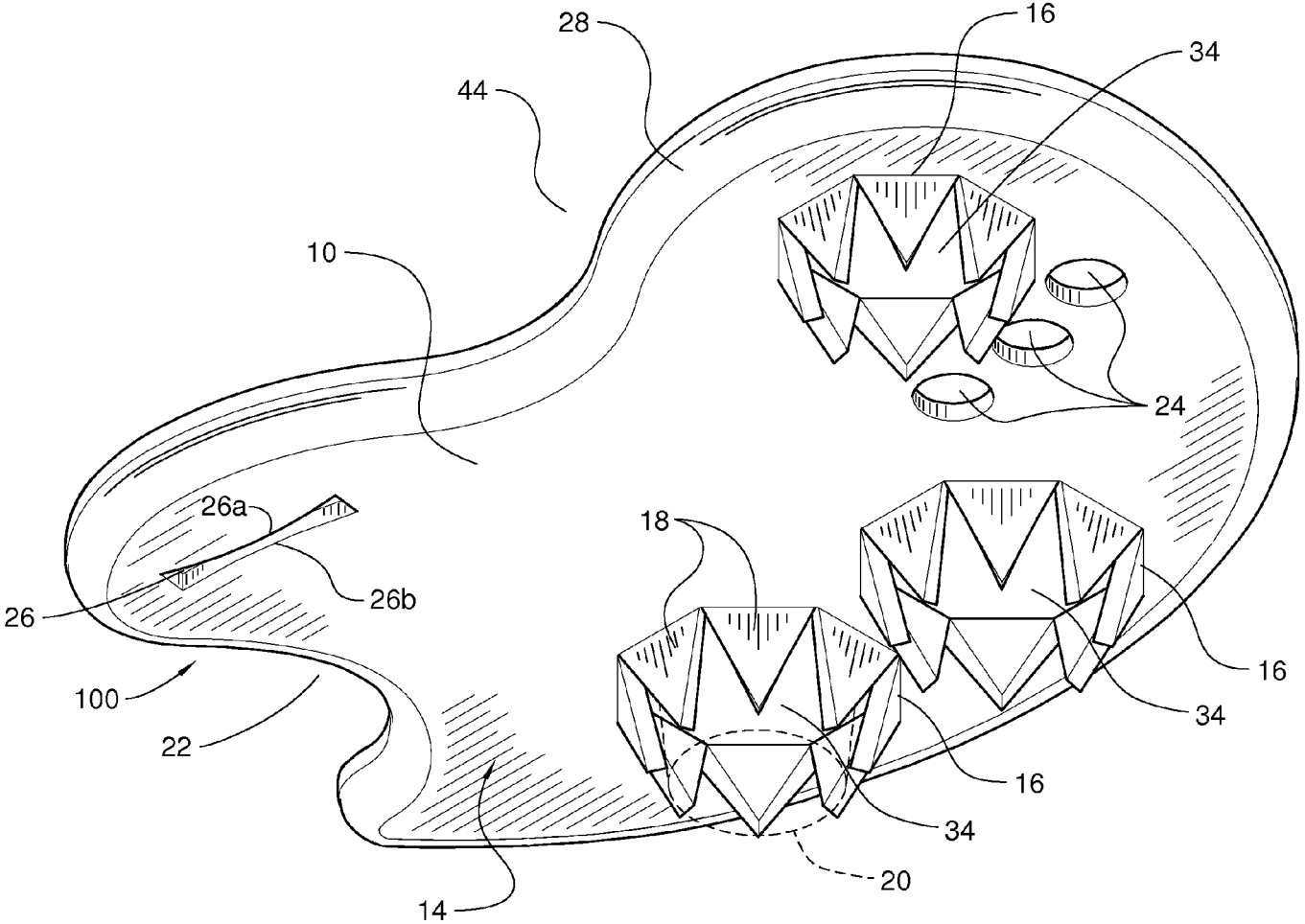
FIG. 2 is a bottom perspective view of the food and/or beverage tray according to the first embodiment of the invention, wherein the bendable flaps of the beverage container holders are in a folded state.
Figure 3:
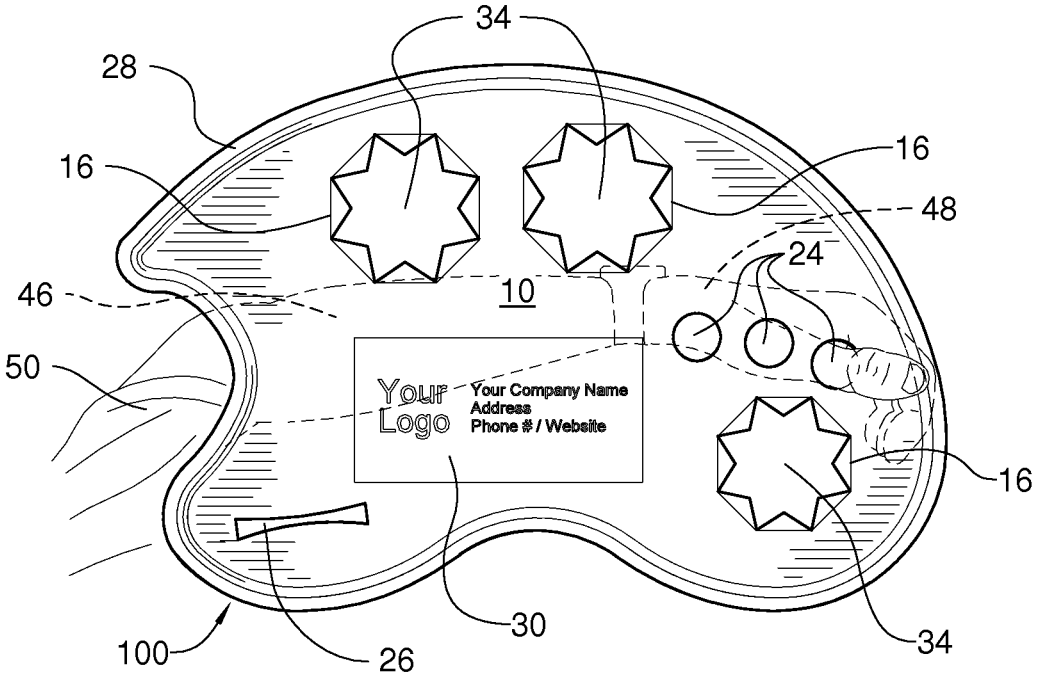
FIG. 3 is a top plan view of the food and/or beverage tray according to the first embodiment of the invention, wherein the bendable flaps of the beverage container holders are in a folded state.
Figure 4:
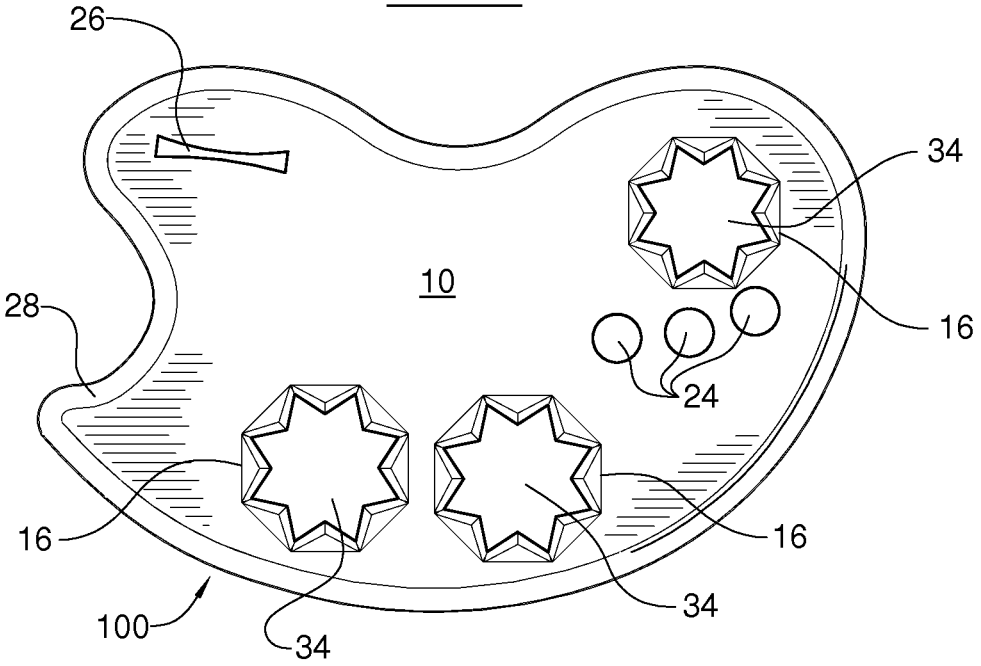
FIG. 4 is a bottom plan view of the food and/or beverage tray according to the first embodiment of the invention, wherein the bendable flaps of the beverage container holders are in a folded state.

A first embodiment of a food and/or beverage tray is seen generally at 100 in FIGS. 1-7 (i.e., a food and beverage tray 100). In the first exemplary embodiment, the food and/or beverage tray 100 comprises a plurality of beverage container holders 16, each comprising a plurality of bendable flap members 18, and a tray body portion 10 having an upturned edge 28 disposed about its periphery. As illustrated in FIGS. 1 and 2, the tray body portion 10 has an upper surface 12 (see FIG. 1) for accommodating food items, and a lower surface 14 (see FIG. 2) which is disposed generally opposite to the upper surface 12. Referring to FIG. 3, it can be seen that a first portion of the lower surface 14 of the tray body portion 10 is configured to rest on the forearm 46 of a user, while a second portion of the lower surface 14 of the tray body portion 10 is configured to rest on the hand 48 of the user.

Turning again to FIGS. 1 and 2, it can be seen that a notch 22 is provided in a first end 10*a* of the tray body portion 10. The notch 22 is configured to receive a cross-sectional portion of an arm 50 of the user, and preferably has a generally parabolic shape. As shown in FIG. 3, the cross-sectional portion of the user's arm received in the notch 22 is located proximate to an elbow of the user. In addition, as depicted in FIGS. 1 and 2, a plurality of finger apertures 24 is disposed through the tray body portion 10. The plurality of finger apertures 24 is disposed proximate to a second end 10*b* of the tray body portion 10, which is oriented generally opposite to the first end 10*a* of the tray body portion 10. The finger apertures 24 are disposed in a spaced apart relationship through the tray body portion 10, and are designed to accommodate the fingers of different users with varying arm lengths. For example, a user with a relatively short forearm might prefer to use the finger aperture 24 that is furthest from the edge 28 of the tray body portion 10, while a user having a relatively long forearm might prefer to use the finger aperture 24 that is closest to the edge 28.

In a preferred embodiment, the plurality of finger apertures 24 are substantially aligned with the center portion of the notch 22 along a longitudinally-disposed reference axis RA extending between opposed ends 10*a*, 10*b* (see FIG. 1). This arrangement conforms to the generally linear extending direction of the user's arm. Also, as best shown in FIG. 3, the plurality of finger apertures 24 can be arranged in a slightly curved pattern, wherein each of the plurality of finger apertures 24 is slightly offset with respect to the other finger apertures 24 in a longitudinal direction.

Figure 15:
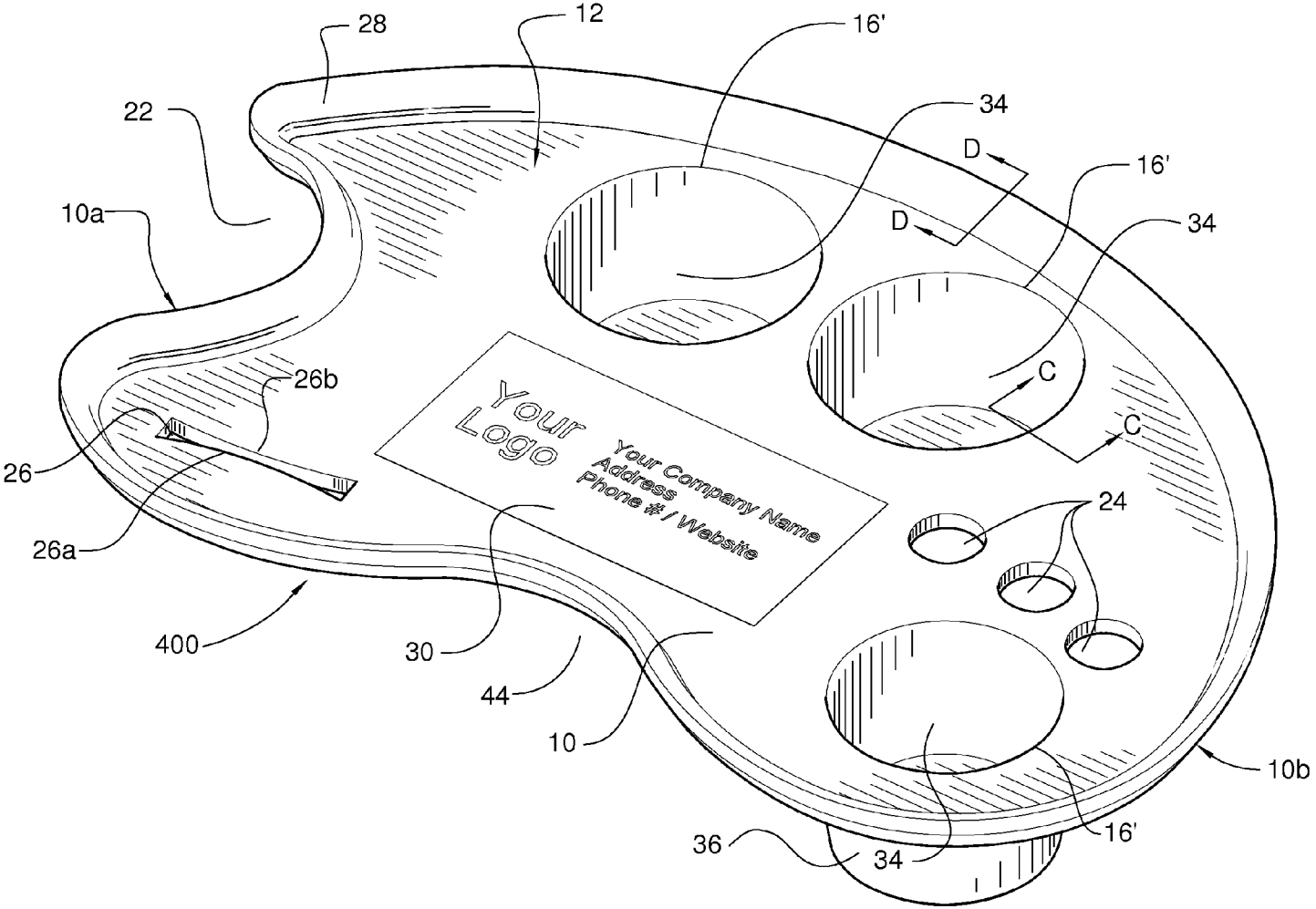
FIG. 15 is a top perspective view of the food and/or beverage tray according to a fourth embodiment of the invention, wherein the beverage container holders are in the form of frusto-conical beverage wells.
Figure 16:
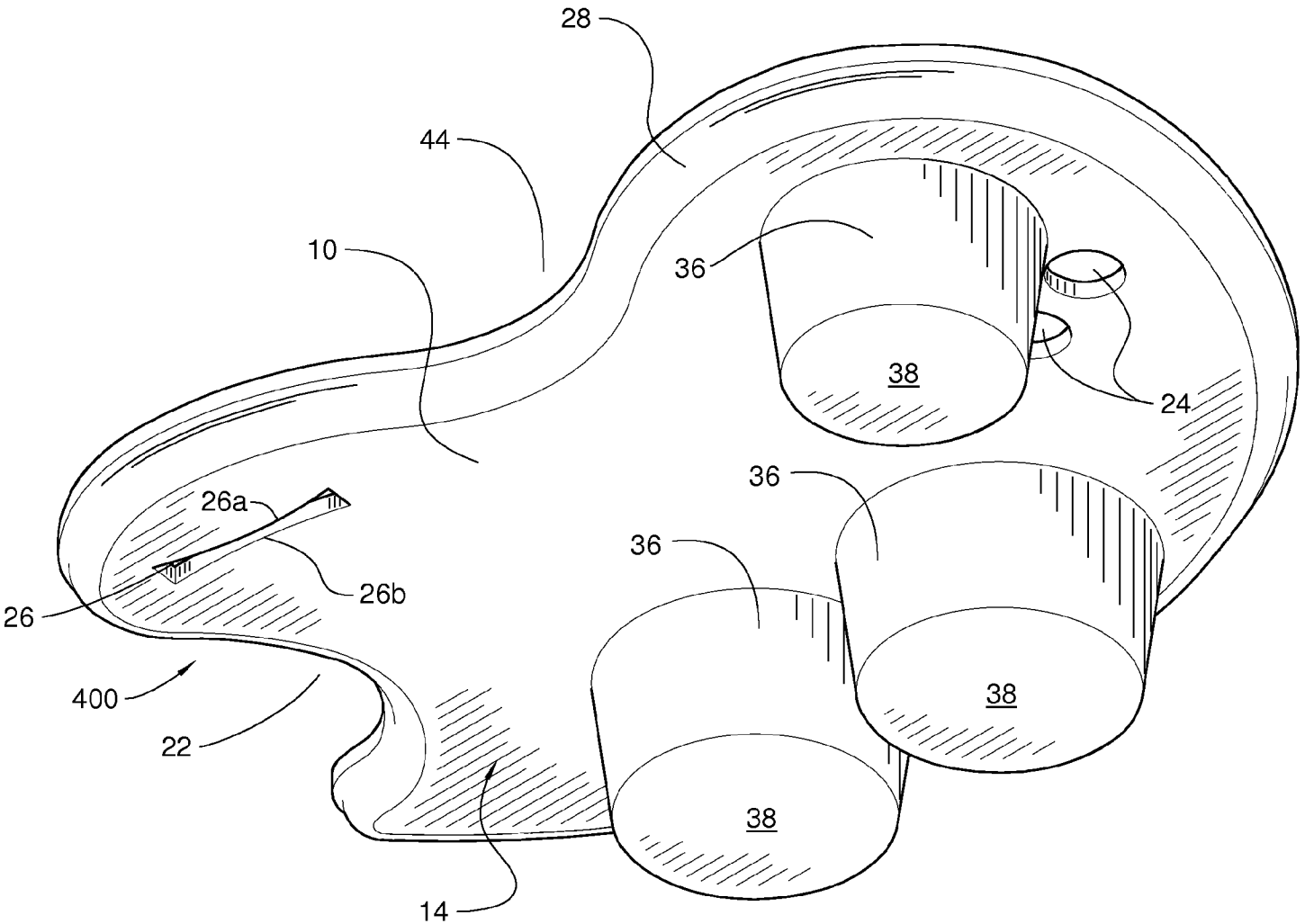
FIG. 16 is a bottom perspective view of the food and/or beverage tray according to the fourth embodiment of the invention, wherein the beverage container holders are in the form of frusto-conical beverage wells.
Figure 17:
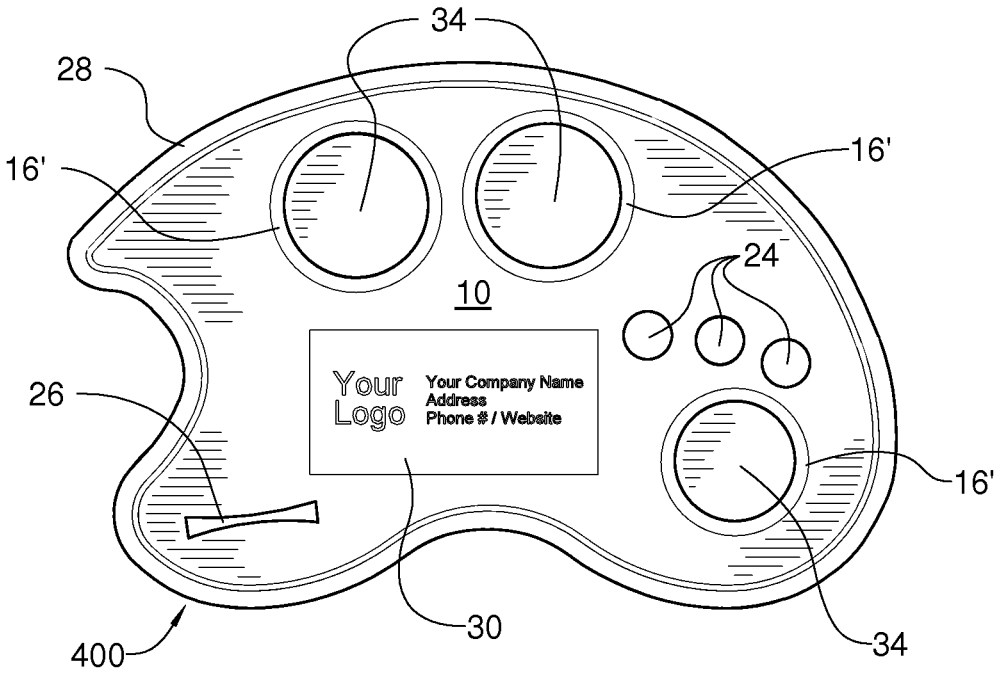
FIG. 17 is a top plan view of the food and/or beverage tray according to the fourth embodiment of the invention, wherein the beverage container holders are in the form of frusto-conical beverage wells.
Figure 18:
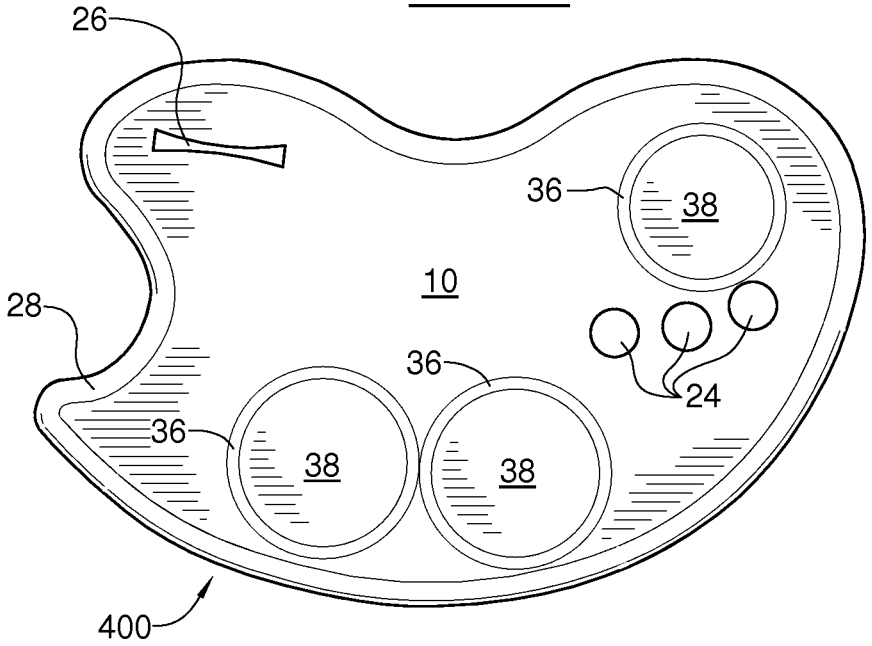
FIG. 18 is a bottom plan view of the food and/or beverage tray according to the fourth embodiment of the invention, wherein the beverage container holders are in the form of frusto-conical beverage wells.
Figure 19:
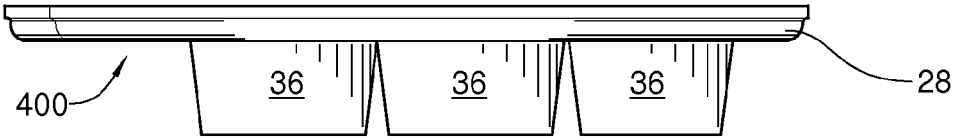
FIG. 19 is a side view of the food and/or beverage tray according to the fourth embodiment of the invention, wherein the beverage container holders are in the form of frusto-conical beverage wells.
Figure 20:
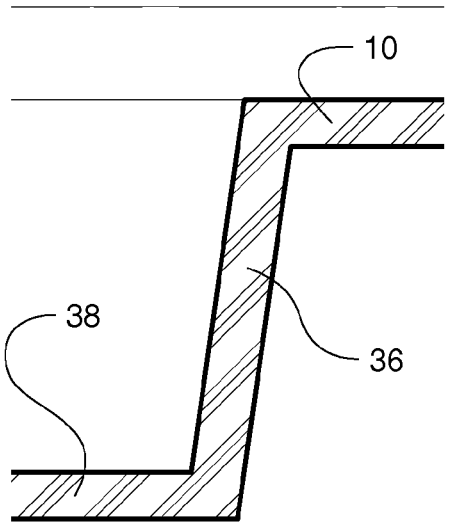
FIG. 20 is a partial sectional view of the food and/or beverage tray according to the fourth embodiment of the invention illustrating the frusto-conical beverage well construction, which is cut along the cutting-plane line C-C in FIG. 15.

Also, in a preferred embodiment, the tray body portion 10 further includes a torso notch 44 (see e.g., FIGS. 1 and 15), which is provided in one of the longitudinal sides of the tray body portion 10 between the opposed ends 10*a*, 10*b*. Similar to the notch 22, the torso notch 44 has a generally parabolic shape, but with a more gradual slope as compared to the notch 22. Advantageously, the torso notch 44 generally conforms to the contours of a user's torso, and thus, allows a user to position the food and/or beverage tray 100 snuggly against his or torso (e.g., directly above his or her waistline) for increased stability.

Figure 21:
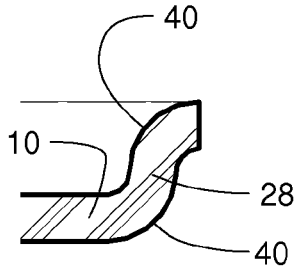
FIG. 21 is a partial sectional view of the food and/or beverage tray illustrating the upturned edge construction, which is cut along the cutting-plane line D-D in FIG. 15.

The food and/or beverage tray 100 is designed to accommodate food items, or beverage items, or both food and beverage items. The generally planar portion of the tray body portion 10 (e.g., with indicia 30) is designed to accommodate food items (e.g., a sandwich, a hot dog, or chips, etc.), whereas the beverage container holders 16 are designed to accommodate beverages (e.g., a tapered cup containing beer or soda). The upturned edge 28 disposed about the periphery of the tray body portion 10 is configured to prevent food items from falling off the tray 100 in the event that a user inadvertently tilts the tray 100. As best shown in the section view of FIG. 21, the cross-section of the upturned edge 28 preferably comprises one or more filleted portions 40 so that the edge 28 has a relatively curved contour. In the illustrated embodiment, it can be seen that the upturned edge 28 extends around the entire periphery of the tray body portion 10. However, in other embodiments of the invention, the upturned edge 28 only extends around a portion of the periphery of the tray body portion 10. For example, in one such embodiment, the upturned edge 28 extends around a substantial portion of the periphery of the tray body portion 10, but does not extend around the notch 22.

In one embodiment, the upturned edge 28 has a height ranging from approximately one-half (½) inch to approximately one (1) inch. More particularly, in one embodiment, the upturned edge 28 has a height of approximately three-quarters (¾) of an inch. Although, one of ordinary skill in the art will appreciate that other suitable heights for the upturned edge 28 may be used as well.

Figure 5:
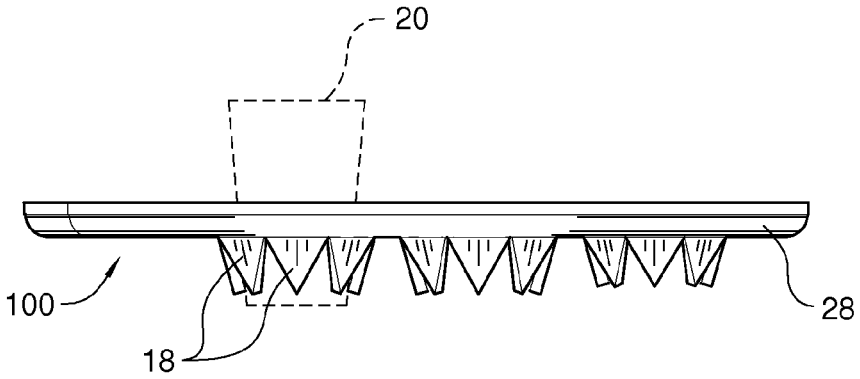
FIG. 5 is a side view of the food and/or beverage tray according to the first embodiment of the invention, wherein the bendable flaps of the beverage container holders are in a folded state.
Figure 6A:
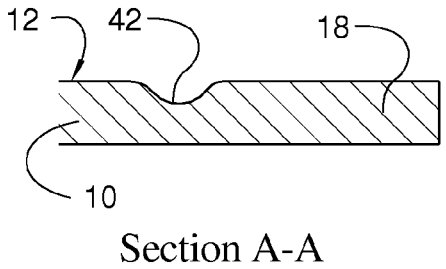
FIG. 6A is a partial sectional view of the food and/or beverage tray according to the first embodiment of the invention depicting a line of weakness in the form of a single groove, which is cut along the cutting-plane line A-A in FIG. 7.
Figure 6B:
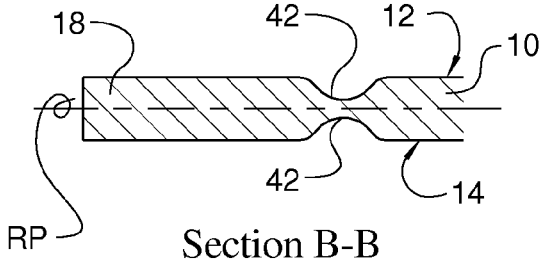
FIG. 6B is a partial sectional view of the food and/or beverage tray according to the first embodiment of the invention depicting a line of weakness in the form of two grooves, which is cut along the cutting-plane line B-B in FIG. 7.
Figure 7:
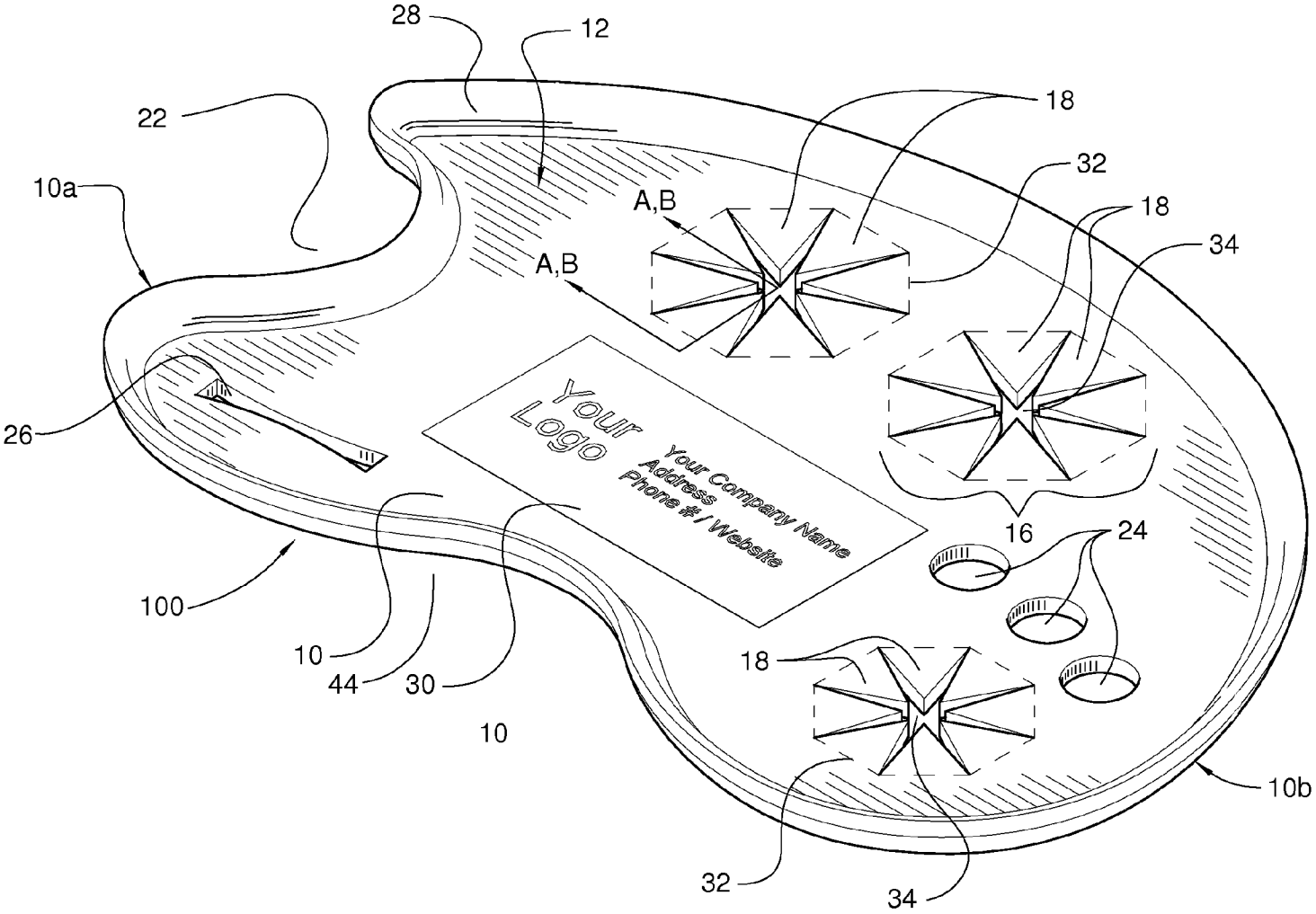
FIG. 7 is a top perspective view of the food and/or beverage tray according to the first embodiment of the invention, wherein the bendable flaps of the beverage container holders are in an unfolded state.

Referring to FIG. 1, it can be seen that, in the first exemplary embodiment, a beverage container 20 (depicted using dashed lines) is supported in the beverage container holder 16 by a plurality of bendable flap members 18. Advantageously, the beverage container holders 16 in the tray body portion 10 greatly enhance the functionality of the tray 100, when it is used to hold beverages, by substantially preventing the tipping of the beverage containers 20 disposed therein. FIG. 7 illustrates the unfolded state of the bendable flap members 18 of each beverage container holder 16 before they are bent downwardly to accommodate a beverage container 20. In their unfolded state, the bendable flap members 18 project in a substantially linear manner from the tray body portion 10, whereas, in their folded state, the bendable flap members 18 extend diagonally downward from the lower surface 14 of the tray body portion 10 (e.g., when the bendable flap members 18 are bent at an acute angle as illustrated in FIG. 5). The bendable flap members 18 of each beverage container holder 16 form the boundary around a beverage aperture 34, which sized to accommodate the beverage container 20.

In order to facilitate the bending of the flap members 18, a line of weakness 32 is preferably provided at the location where each bendable flap member 18 connects to the tray body portion 10 (refer to FIG. 7). In one embodiment of the invention (e.g., see sectional view of FIG. 6B), the line of weakness 32 comprises two generally aligned grooves 42 on both the upper surface 12 and the lower surface 14 of the tray body portion 10, the two generally aligned grooves 42 being disposed in a substantially mirrored relationship with respect to a central reference plane RP passing through the tray body portion 10. In another embodiment, the line of weakness 32 comprises a single groove 42 on either the upper surface 12 of the tray body portion 10 (see FIG. 6A) or the lower surface 14 of the tray body portion 10. In some embodiments, the groove(s) 42 will be formed using an impression built into thermal press tooling. In yet another embodiment, the line of weakness 32 comprises a series of spaced apart slits disposed at the location where each bendable flap member 18 connects to the tray body portion 10.

Turning again to FIGS. 1 and 2, it can be seen that the tray body portion 10 further includes an elongated slot 26 disposed therethrough for holding a portable electronic device (e.g., a cellular or mobile phone, a smartphone, a personal digital assistant (PDA), an MP3 player, etc.). As shown in these figures, the elongated slot 26 is preferably longitudinally bounded by two convex sides 26*a*, 26*b* for retaining the portable electronic device in a friction fit engagement. Although, in other embodiments, the elongated slot 26 could be provided with generally straight longitudinal sides (in such a case, the elongated slot 26 would have a generally rectangular geometry). Also, in other embodiments, the elongated slot 26 could be located in a different location on the tray body portion 10 (e.g., the elongated slot 26 could be located near the second end 10*b* of the tray body portion 10, rather than near the first end 10*a* thereof, as illustrated in the figures).

In a preferred embodiment, a portion of the upper surface 12 of the tray body portion 10 comprises indicia 30 imprinted or affixed thereon. In some embodiments, the indicia 30 will be post-printed on the tray body portion 10. Although, in other embodiments, especially those comprising trays formed from paper, the tray 100 will be made such that nearly the entire upper surface 12 of the tray body portion 10 constitutes a theme, message, and/or logo (similar to wallpaper), and thus, will not require any post processing. Preferably, the indicia 30 comprise one of the following: (i) a company name and/or logo; (ii) a sports team name and/or logo; and (iii) a celebratory message or theme. For example, when the indicia 30 in the form of a company name and/or logo is provided, the food and/or beverage tray 100 can be used for advertising purposes. In such a case, a company could purchase a large quantity of the beverage trays, print its name and/or logo on the trays 100, and then distribute the trays 100 free of charge at a social gathering in order to promote its business (e.g., the trays 100 could be distributed to the attendees of a tailgate party).

2. Second Embodiment

Figure 8:
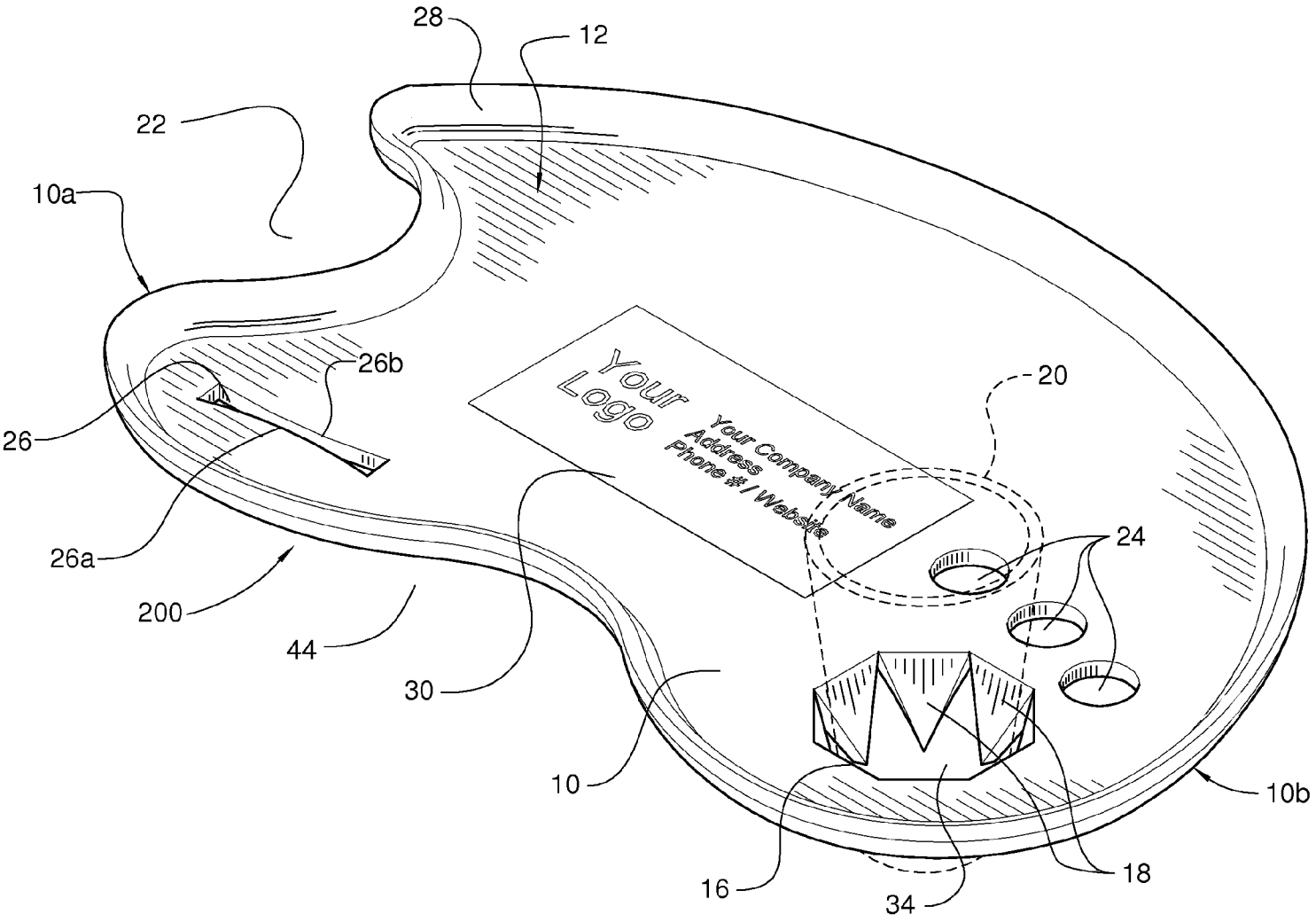
FIG. 8 is a top perspective view of the food and/or beverage tray according to a second embodiment of the invention, wherein the bendable flaps of the beverage container holders are in a folded state.
Figure 9:
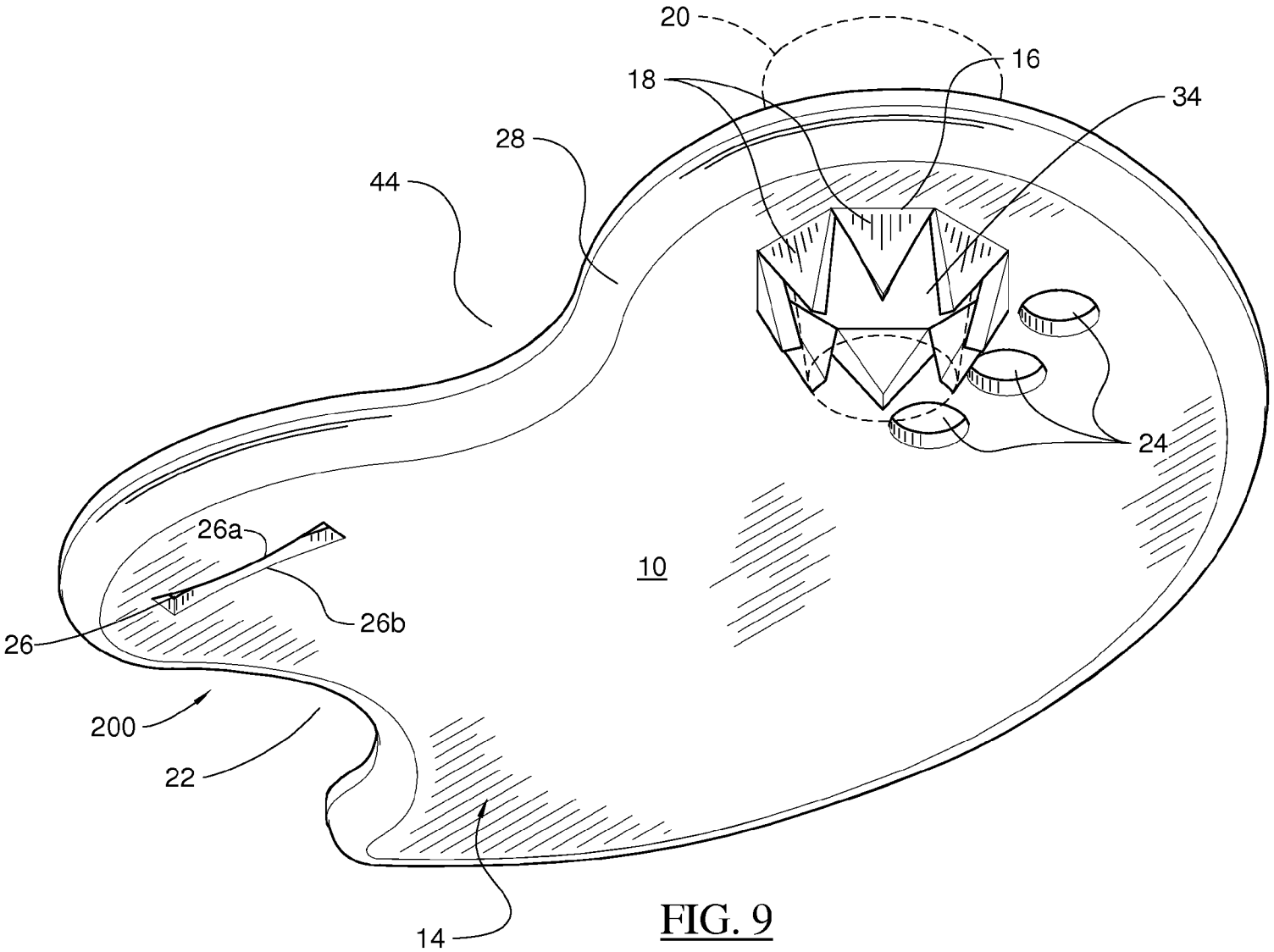
FIG. 9 is a bottom perspective view of the food and/or beverage tray according to the second embodiment of the invention, wherein the bendable flaps of the beverage container holders are in a folded state.
Figure 10:
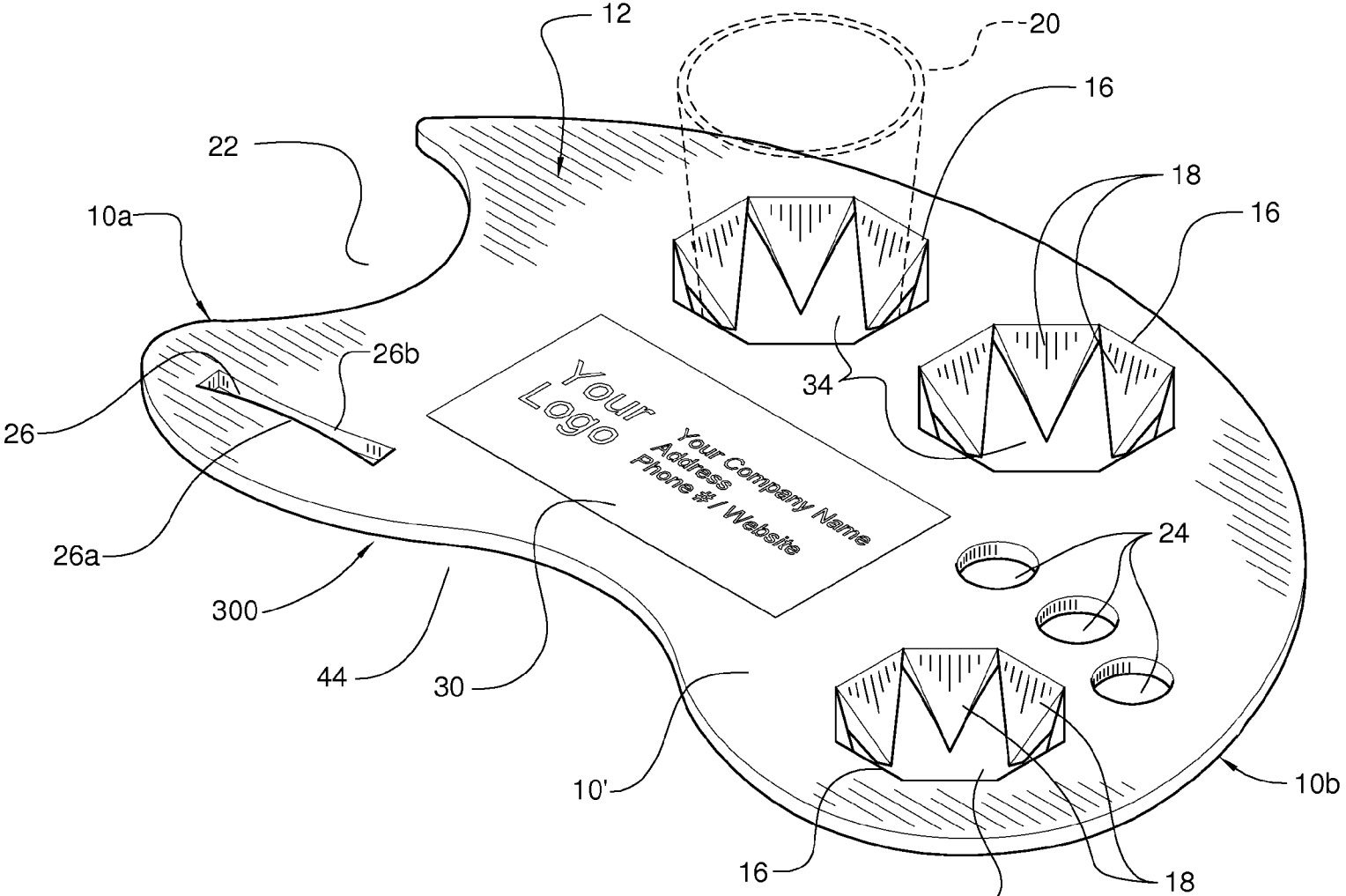
FIG. 10 is a top perspective view of the food and/or beverage tray according to a third embodiment of the invention, wherein the bendable flaps of the beverage container holders are in a folded state.
Figure 11:
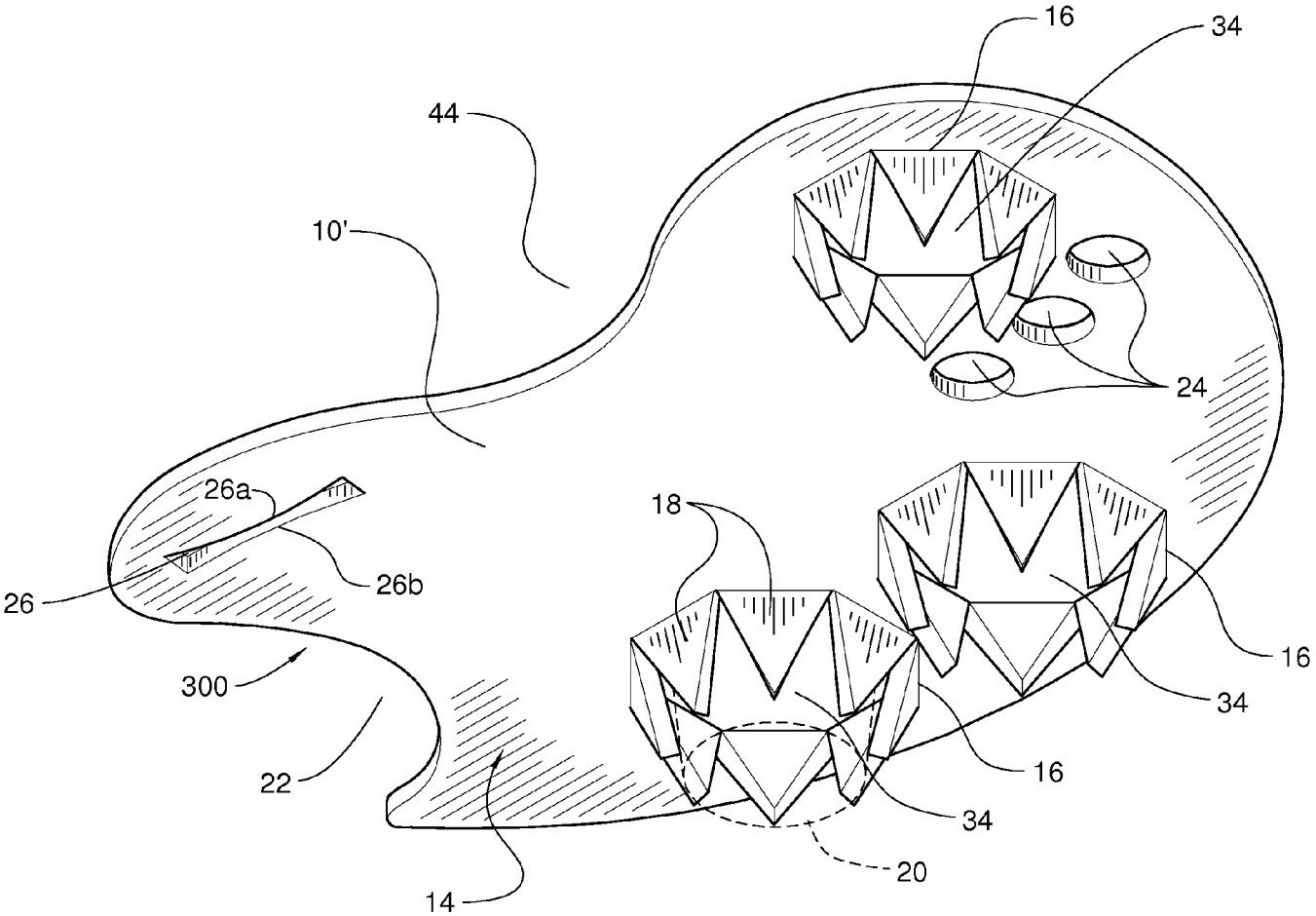
FIG. 11 is a bottom perspective view of the food and/or beverage tray according to the third embodiment of the invention, wherein the bendable flaps of the beverage container holders are in a folded state.
Figure 12:
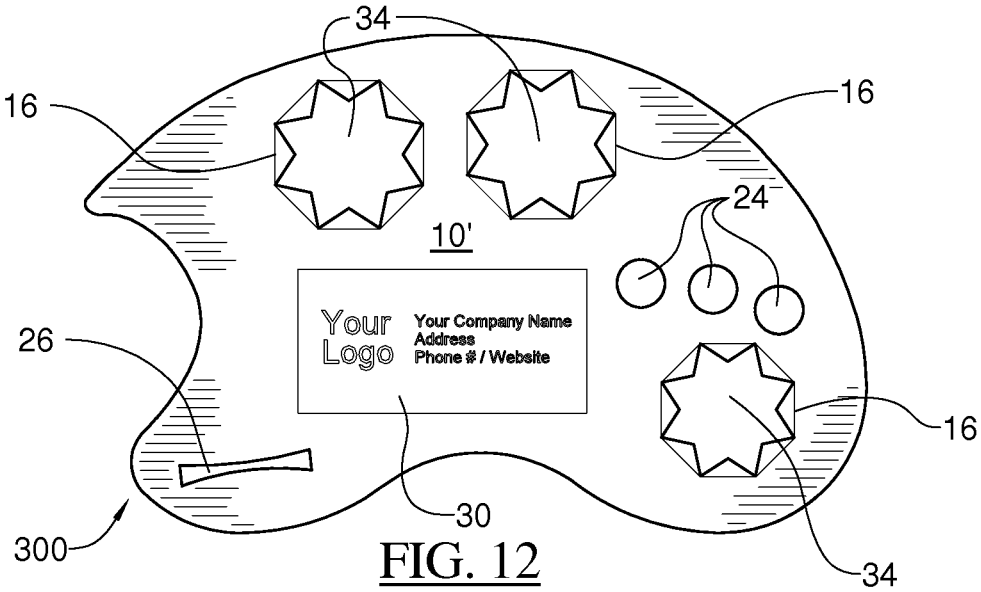
FIG. 12 is a top plan view of the food and/or beverage tray according to the third embodiment of the invention, wherein the bendable flaps of the beverage container holders are in a folded state.
Figure 13:
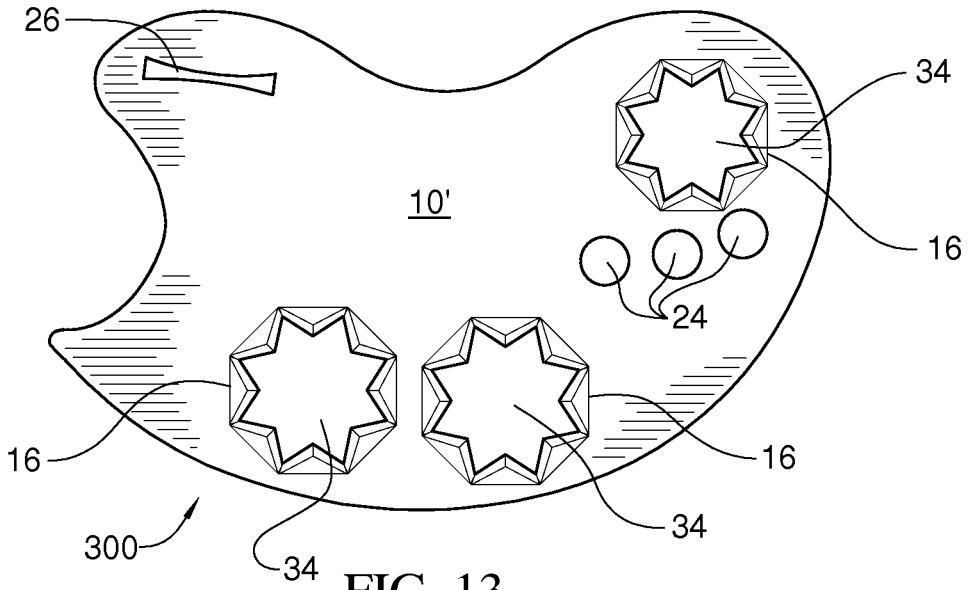
FIG. 13 is a bottom plan view of the food and/or beverage tray according to the third embodiment of the invention, wherein the bendable flaps of the beverage container holders are in a folded state.
Figure 14:
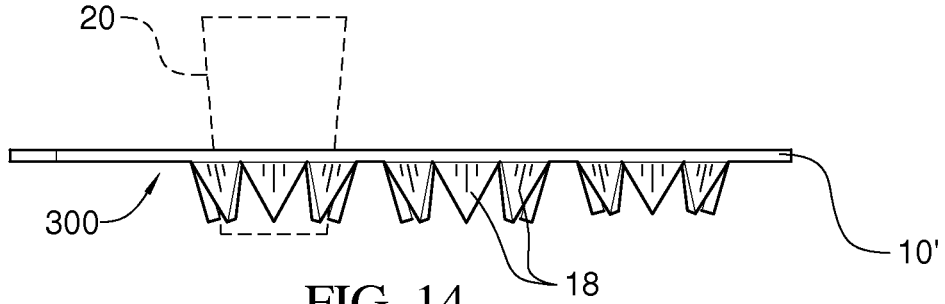
FIG. 14 is a side view of the food and/or beverage tray according to the third embodiment of the invention, wherein the bendable flaps of the beverage container holders are in a folded state.

A second embodiment of the food and/or beverage tray is seen generally at 200 in FIGS. 8 and 9. Referring to these figures, it can be seen that, in many respects, the second exemplary embodiment is similar to that of the first embodiment. Moreover, many elements are common to both such embodiments. For the sake of brevity, the elements that the second embodiment of the food and/or beverage tray has in common with the first embodiment will not be discussed because these components have already been explained in detail above. Furthermore, in the interest of clarity, these elements are denoted using the same reference characters that were used in the first embodiment.

In the second exemplary embodiment, the food and/or beverage tray 200 is only provided with a single beverage container holder 16, rather than the plurality of beverage container holders 16 depicted in the first embodiment. In all other respects, the food and/or beverage tray 200 is generally the same as the food and/or beverage tray 100. In this embodiment, because only a single beverage container holder 16 is provided in the tray body portion 10, there is more room to accommodate additional food items. For example, the food and/or beverage tray 200 is particularly well suited for accommodating an entire meal (e.g., a sandwich and one or more side dishes). The food and/or beverage tray 200 of the second embodiment could also be used for accommodating several slices of pizza, etc. Advantageously, because the food and/or beverage tray 200 only includes a single beverage container holder 16, there is sufficient room on the lower surface 14 of the tray body portion 10 for a user to extend his or her hand in an essentially flat position against the lower surface 14, and to place his or her index finger, middle finger or ring finger through one of the finger apertures 24, in order to facilitate added stability.

In an alternative embodiment of the invention, the food and/or beverage tray could be similar in most respects to the food and/or beverage tray 200, except that it would be provided without any beverage container holders 16. This version of the food and/or beverage tray would be considered the "food only" version of the tray. Because the omission of all the beverage container holders 16 would permit more free space on the upper surface 12 of the tray body portion 10, this version of the food and/or beverage tray would be particularly well suited for accommodating a full plate of food (i.e., a full meal including, for example, a sandwich, multiple side dishes, dessert, etc.).

3. Third Embodiment

A third embodiment of the food and/or beverage tray is seen generally at 300 in FIGS. 10-14. Referring to these figures, it can be seen that, in many respects, the third exemplary embodiment is similar to that of the first and second embodiments. Moreover, many elements are common to all such embodiments. For the sake of brevity, the elements that the third embodiment of the food and/or beverage tray has in common with the first and second embodiments will not be discussed because these components have already been explained in detail above. Furthermore, in the interest of clarity, these elements are denoted using the same reference characters that were used in the first and second embodiments.

In the third exemplary embodiment, unlike the first and second embodiments, the food and/or beverage tray 300 is not provided with an upturned edge 28 disposed around the circumference of the tray body portion 10. Rather, the tray body portion 10' of the food and/or beverage tray 300 has a generally planar shape throughout. In all other respects, the food and/or beverage tray 300 is generally the same as the food and/or beverage tray 100. Because the upturned edge 28 is omitted in this embodiment, the food and/or beverage tray 300 is particularly well suited as a "drink only" tray. For example, the food and/or beverage tray 300 might be used in place of a conventional drink carrying tray because of its increased stability and more ergonomic design.

The food and/or beverage trays 100, 200, and 300, can be formed using various suitable materials. For example, the food and/or beverage trays 100, 200, 300 could be made from a sheet of heavy weight paper, corrugated cardboard, or a polymer corrugated board material. As such, the beverage container holders 16 in the first three embodiments would preferably be cut into a sheet of the material forming the tray body portion 10, 10'. In one embodiment, the food and/or beverage trays 100, 200, and 300 could be formed from a recycled material, such as recycled paper or cardboard, so as to promote sustainable initiatives. Also, in some embodiments, the food and/or beverage trays 100, 200, and 300 would be designed to be disposable and recyclable.

4. Fourth Embodiment

A fourth embodiment of the food and/or beverage tray is seen generally at 400 in FIGS. 15-20. Referring to these figures, it can be seen that, in many respects, the fourth exemplary embodiment is similar to that of the previous embodiments. Moreover, many elements are common to all such embodiments. For the sake of brevity, the elements that the fourth embodiment of the food and/or beverage tray has in common with the first three embodiments will not be discussed because these components have already been explained in detail above. Furthermore, in the interest of clarity, these elements are denoted using the same reference characters that were used in the first, second, and third embodiments.

In the fourth exemplary embodiment, the food and/or beverage tray 400 is provided with beverage container holders 16' in the form of frusto-conical beverage wells, rather than beverage container holders 16 having bendable flap members 18. In all other respects, the food and/or beverage tray 400 is generally the same as the food and/or beverage tray 100. In this embodiment, each beverage container holder 16' includes a tapered, frusto-conical side wall 36 connected to the tray body portion 10 and a generally planar bottom wall 38 connected to the bottom edge of the frusto-conical side wall 36 (e.g., refer to FIG. 16).

In a preferred embodiment, each frusto-conical beverage well is integrally formed with the tray body portion 10. For example, the frusto-conical beverage wells could be molded together with the tray body portion 10. Advantageously, the molded construction of the food and/or beverage tray 400 increases its overall structural rigidity and carrying capacity. As such, the food and/or beverage tray 400 is particularly well suited for accommodating heavier beverage containers 20, such as glass bottles or cans that are completely full. The molded frusto-conical beverage wells of the food and/or beverage tray 400 are readily capable of withstanding the weight of such bottles and cans.

Like food and/or beverage trays 100, 200, and 300, the food and/or beverage tray 400 can be formed using various suitable materials. For example, the food and/or beverage tray 400 could be molded from a suitable foam or a pressed pulp. In one embodiment, the food and/or beverage tray 400 would be formed from a recycled material, such as a pressed pulp containing recycled content, so as to promote sustainable initiatives. Also, in some embodiments, the food and/or beverage tray 400 would be designed to be disposable and recyclable.

5. Functionality of the Food and/or Beverage Tray

Now, referring to FIGS. 1 and 3, the functionality of the food and/or beverage tray will be explained. In particular, the manner in which a user arranges the device on his or her person will be described.

Initially, referring to FIG. 3, a user positions a cross-sectional portion of his or her arm 50 in the notch 22 provided in the first end 10*a* of the tray body portion 10. For example, as shown in FIG. 3, approximately one-third (⅓) to one-half (½) of the cross-section of the user's arm 50 is received within the notch 22 of the food and/or beverage tray 100. Then, a user selects one of the plurality of finger apertures 24 based upon the length of his or her forearm. Generally, the user will select the finger aperture 24 which allows the user to most comfortably hold the food and/or beverage tray 100 in his or her arm 50. After the user has selected his or her preferred finger aperture 24, the user positions his or her thumb, index finger, middle finger or ring finger in the selected finger aperture 24. For increased stability, the user may also position the torso notch 44 of the food and/or beverage tray 100 snuggly against his or her torso (e.g., directly above his or her waistline). After the user comfortably positions his or her arm 50 in the notch 22 of the food and/or beverage tray 100 and his or her finger in the selected finger aperture 24, the user is able to securely support the food and/or beverage tray 100 using both his or her forearm 46 and hand 48. Once the food and/or beverage tray 100 is appropriately positioned, the ergonomic design of the tray 100 enables the opposed ends 10*a*, 10*b* of the tray body portion 10 to be gently squeezed by the user in order to further enhance the stability of the tray 100.

While the functionality of the food and/or beverage tray was described with regard to the food and/or beverage tray 100, those of ordinary skill in the art will recognize that the aforedescribed functionality of the food and/or beverage tray is equally applicable to all other embodiments of the food and/or beverage tray (e.g., food and/or beverage trays 200, 300, and 400).

It is readily apparent that the aforedescribed food and/or beverage tray 100, 200, 300, 400 offers numerous advantages. First, the food and/or beverage tray greatly facilitates eating and drinking by a user while in a standing position. Secondly, because the food and/or beverage tray is designed to be held by using both one's forearm and hand, the tray can be easily balanced and stabilized by a user thereof. Finally, the ergonomic design of the food and/or beverage tray enables it to be securely supported by a single hand of a user, thus enabling the user's other hand to be free for grasping the food and/or beverage(s) placed on the tray.

6. Other Modifications and Variations

Although the invention has been shown and described with respect to a certain embodiment or embodiments, it is apparent that this invention can be embodied in many different forms and that many other modifications and variations are possible without departing from the spirit and scope of this invention.

For example, while bendable flap members 18 are depicted as having a generally triangular shape in the exemplary embodiments described above, one of ordinary skill in the art will appreciate that the bendable flap members 18 may be formed using other suitable shapes as well, such as rectangular shapes, trapezoidal shapes, or semi-circular shapes.

While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A food and/or beverage tray configured to be supported using a forearm and a hand of a user, said food and/or beverage tray comprising:

a tray body portion having an upper surface and a lower surface, a first portion of said lower surface of said tray body portion configured to rest on said forearm of said user, a second portion of said lower surface of said tray body portion configured to rest on said hand of said user;

a notch provided in a first end of said tray body portion, said notch being configured to receive a cross-sectional portion of an arm of said user, said cross-sectional portion of said arm of said user being located proximate to an elbow of said user;

at least one finger aperture disposed through said tray body portion, said at least one finger aperture configured to accommodate a finger of said hand of said user, said at least one finger aperture being located proximate to a second end of said tray body portion that is disposed generally opposite to said first end of said tray body portion; and at least one beverage container holder formed in said tray body portion, said at least one beverage container holder comprising at least one beverage aperture disposed through said tray body portion, said at least one beverage aperture bounded by a plurality of bendable flap members connected to said tray body portion, said plurality of bendable flap members being configured to be bent in a generally downward direction such that said bendable flap members project from said lower surface of said tray body portion in a folded state.

2. The food and/or beverage tray according to claim 1, wherein said tray body portion comprises an upturned edge at its periphery, said upturned edge of said tray body portion configured to prevent food items from falling off said tray if said tray is tilted by said user.

3. The food and/or beverage tray according to claim 2, wherein said upturned edge of said tray body portion extends around the entirety of said periphery of said tray body portion.

4. The food and/or beverage tray according to claim 2, wherein a cross-section of said upturned edge comprises one or more filleted portions.

5. The food and/or beverage tray according to claim 1, wherein said at least one beverage container holder comprises a plurality of said beverage container holders.

6. The food and/or beverage tray according to claim 1, wherein each of said plurality of bendable flap members comprises at least one line of weakness at the location where each said bendable flap member connects to said tray body portion.

7. The food and/or beverage tray according to claim 6, wherein said at least one line of weakness comprises a groove on either said upper surface or said lower surface of said tray body portion.

8. The food and/or beverage tray according to claim 6, wherein said at least one line of weakness comprises two generally aligned grooves on both said upper surface and said lower surface of said tray body portion, said two generally aligned grooves being disposed in a substantially mirrored relationship with respect to a central reference plane passing through said tray body portion.

9. The food and/or beverage tray according to claim 6, wherein said at least one line of weakness comprises a series of spaced apart slits.

10. The food and/or beverage tray according to claim 1, wherein said at least one finger aperture comprises a plurality of finger apertures disposed in a spaced apart relationship through said tray body portion, said plurality of finger apertures configured to accommodate the fingers of different users with varying forearm lengths, said plurality of finger apertures being located proximate to said second end of said tray body portion.

11. The food and/or beverage tray according to claim 1, wherein said tray body portion further comprises an elongated slot disposed therethrough for holding a portable electronic device.

12. The food and/or beverage tray according to claim 11, wherein said elongated slot is longitudinally bounded by two convex sides for retaining said portable electronic device in a friction fit engagement.

13. The food and/or beverage tray according to claim 1, wherein a portion of said upper surface of said tray body portion comprises indicia printed or affixed thereon.

14. The food and/or beverage tray according to claim 13, wherein said indicia comprises one of the following: (i) a company name and/or logo; (ii) a sports team name and/or logo; and (iii) a celebratory message or theme.

15. The food and/or beverage tray according to claim 1, wherein said tray body portion has a generally planar shape.

16. A method of using a food and/or beverage tray, said method comprising the steps of:

providing a food and/or beverage tray configured to be supported using a forearm and a hand of a user, said food and/or beverage tray including:

a tray body portion having an upper surface and a lower surface, a portion of said lower surface of said tray body portion configured to rest on said forearm of said user;

a notch provided in a first end of said tray body portion, said notch being configured to receive a cross-sectional portion of an arm of said user, said cross-sectional portion of said arm of said user being located proximate to an elbow of said user;

a plurality of finger apertures disposed in a spaced apart relationship through said tray body portion, said plurality of finger apertures configured to accommodate the fingers of different users with varying forearm lengths, said plurality of finger apertures being located proximate to a second end of said tray body portion that is disposed generally opposite to said first end of said tray body portion; and at least one beverage container holder formed in said tray body portion, said at least one beverage container holder comprising at least one beverage aperture disposed through said tray body portion, said at least one beverage aperture bounded by a plurality of bendable flap members connected to said tray body portion, said plurality of bendable flap members being configured to be bent in a generally downward direction such that said bendable flap members project from said lower surface of said tray body portion in a folded state;

positioning a cross-sectional portion of an arm of said user in said notch provided in said first end of said tray body portion;

selecting one of said plurality of finger apertures based upon the length of the user's forearm;

positioning one of: (i) an index finger; (ii) a middle finger; and (iii) a ring finger of said user in the selected one of said plurality of finger apertures;

supporting said food and/or beverage tray using both said forearm and said hand of said user; and bending said plurality of bendable flap members of said at least one beverage container holder generally downward, and inserting a beverage container into said at least one beverage container holder.

* * * * *